US007070171B2

(12) United States Patent
Mangin

(10) Patent No.: US 7,070,171 B2
(45) Date of Patent: Jul. 4, 2006

(54) HOISTING AND STABILIZATION SYSTEM FOR SUSPENDED LOAD SUPPORT

(75) Inventor: Roger Mangin, Serrouville (FR)

(73) Assignee: Secalt S.A., Luxembourg (LU)

( * ) Notice: Subject to any disclaimer, the term of this patent is extended or adjusted under 35 U.S.C. 154(b) by 226 days.

(21) Appl. No.: 10/864,047

(22) Filed: Jun. 9, 2004

(65) Prior Publication Data

US 2004/0251455 A1 Dec. 16, 2004

(30) Foreign Application Priority Data

Jun. 13, 2003 (LU) ..... 91026

(51) Int. Cl.
*B66D 3/04* (2006.01)

(52) U.S. Cl. ..... 254/394; 254/397

(58) Field of Classification Search ..... 254/285, 254/286, 287, 294, 338, 393, 394, 397
See application file for complete search history.

(56) References Cited

U.S. PATENT DOCUMENTS

| | | | | |
|---|---|---|---|---|
| 3,263,965 | A * | 8/1966 | Mutch | 254/281 |
| 3,801,070 | A * | 4/1974 | Piasecki | 254/285 |
| 4,214,664 | A * | 7/1980 | Polen | 212/274 |
| 4,574,789 | A * | 3/1986 | Forster | 602/32 |
| 5,074,528 | A * | 12/1991 | Long, Jr. | 254/285 |
| 5,772,360 | A * | 6/1998 | Wood, II | 405/3 |
| 6,827,334 | B1 * | 12/2004 | Volle et al. | 254/285 |
| 6,926,260 | B1 * | 8/2005 | De Groot et al. | 254/277 |

FOREIGN PATENT DOCUMENTS

| | | |
|---|---|---|
| BE | 664298 | 9/1965 |
| DE | 1207584 | 12/1965 |
| DE | 2165268 | 4/1976 |
| DE | 4005194 | 8/1990 |
| JP | 52053349 | 4/1977 |

* cited by examiner

*Primary Examiner*—Emmanuel M Marcelo
(74) *Attorney, Agent, or Firm*—Polster, Lieder, Woodruff & Lucchesi, L.C.

(57) ABSTRACT

The suspension and hoisting system for a load support comprises two cable circuits, each comprising a cable (C1, C2) fixed at one of the ends thereof to a fixed point (Pf1, Pf2) and at the other end to a lifting apparatus (T1, T2) and being reeved around deflection pulleys (A1, A2, A3, B1, B2, B3) mounted on two parallel shafts (Ax) located adjacent one and the other end, respectively, of the load support, the lifting apparatus (T1) of one of the two cable circuits being provided above one of the ends of the load support and the lifting apparatus (T2) of the other cable circuit being provided above the other end of the load support. The cable (C1) of at least one of the cable circuits is reeved successively around at least two coaxial deflection pulleys (A2, A3, B2, B3) mounted on each end shaft (Ax) according to such a path that on at least one of the end shafts (Ax) at least one pulley (A1) of said one cable circuit rotates in the same direction as at least one pulley (A2) of the other cable circuit under identical lifting or lowering action of the two lifting apparatus (T1, T2), while these two pulleys (A1, A2) are constrained to rotate in opposite directions by the same downwardly oriented force independently of the action of the lifting apparatus (T1, T2). According to the invention these two pulleys (A1, A2) are interlocked to reduce or eliminate any tendency of the load support to incline under the effect of this downward force.

9 Claims, 13 Drawing Sheets

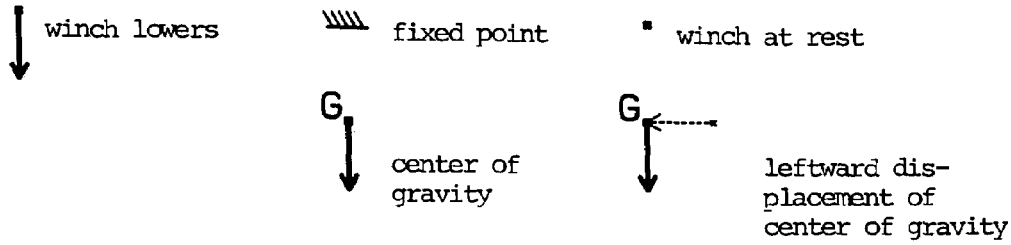
FIG.4
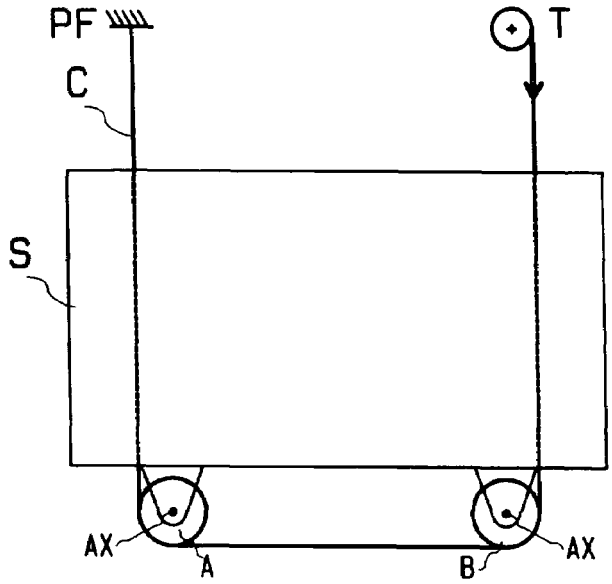
FIG.5
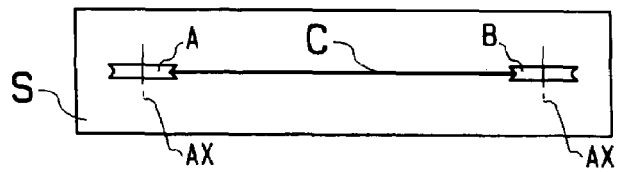
FIG.6
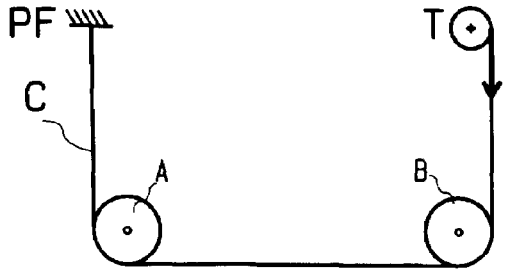

HOISTING AND STABILIZATION SYSTEM FOR SUSPENDED LOAD SUPPORT

CROSS-REFERENCE TO RELATED APPLICATIONS

This application claims priority under 35 U.S.C. §119 to Luxembourg Application No. 91026 filed Jun. 13, 2003 and which is incorporated herein by reference.

STATEMENT REGARDING FEDERALLY SPONSORED RESEARCH OR DEVELOPMENT

Not Applicable.

BACKGROUND OF THE INVENTION

The invention concerns a system for the suspension and hoisting of a load support.

There is known one type of a device for the suspension and hoisting of a load support, such as a work nacelle, wherein the support is suspended by four suspension reaches constituted in total by only at least two suspension elements, such as cables or ropes, each extending down from a fixed point located above one of the opposite ends of the load support, and reeved around circular rotatable deflection supports, such as pulleys, located adjacent the two ends of the load support, and to be connected each to a lifting means, such as a winch, located above the other end of the load support. These circular supports are arranged to be in integral rotation with the suspension elements which they are associated. The circular supports must not be disposed at the ends of the load support but need only be spaced at equal distances from the center of the load support towards the opposite ends thereof, without thereby changing the desired effect. In general, it is recommended for the suspension reaches of such a device to be disposed vertically, but the suspension device may also have oblique suspension reaches. Additionally, it is pointed out that the center of gravity (G) of the load support should be located below the transverse reaches of the cables or ropes joining the pulleys so as to insure the support to be stable in transverse direction. This known system has the advantage of requiring only two lifting means or hoists for four suspension reaches. The FIG. 1 is a schematic illustration of such a known device.

The device as described previously has the disadvantage of providing a load support which will incline longitudinally towards the side of the load by rolling movement of the pulleys on the cables or ropes when the load displaces from the axis of gravity Ag of the support towards one of the load support ends. For example, as soon as a user standing on a support, constituted by a nacelle, which is initially in horizontal position, moves away from the center thereof towards the one or the other end of the nacelle, the nacelle will assume a position inclined towards the same side. The inclination increases until the bottom of the nacelle approaches a position aligned with the suspension reach of the cable or rope located on the side opposite from the side towards which the load is displaced, as shown in FIG. 2. In practice, in the case of the load support being a nacelle, this movement is limited, without being eliminated, by the guiding of the suspension reaches, by means of vertical extensions of the nacelle, such as stirrups. Such a movement limited as referred to above is shown in FIG. 3.

BRIEF SUMMARY OF THE INVENTION

The description to follow refers more particularly to a load support constituted by a nacelle, described successively with one and then with two suspension elements constituted each by a cable or rope reeved around pulleys and actuated by a winch or hoist of the winding type, but the invention applies also to any other equivalent lifting means and to any other equivalent load support, for example those in which the suspension elements would be chains, the circular cable or rope deflection supports would be chain sprockets and/or the load support would be a lifting beam, but the invention is not limited to these embodiments. Further, the following description applies to a system, such as described, wherein at least one of the two suspension elements would be reeved around more than two pulleys on each end shaft, by effecting supplemental returns between the two ends of the support. It also applies to an embodiment in which the system would have more than two suspension elements. The following description applies particularly to embodiments having vertical suspension reaches, but the invention also applies to embodiments having oblique suspension reaches, if particular reasons justify such an arrangement. The sole requirement specific to the suspension by pulleys and cables, ropes or belts is that the coefficient of friction between pulleys and cables, ropes or belts is such that, taking into account the weight of the support and its load, the cooperation between pulleys and cables, ropes or belts is effected substantially without slippage of the cables, ropes or belts in the grooves of the pulleys.

The object of the invention is to provide by simple means a system of the recited type having the advantage of maintaining the load support in a stable and unchanged position when the point of application of the load is not or is no longer located at the center of the support, that is to say at equal distances from the system suspension points.

The hoisting system adapted to embody the invention is applied towards the two opposite ends of the load support, which is suspended by at least four suspension reaches constituted by at least two suspension elements, each suspension element being suspended towards one of the support ends from a fixed point and adjacent the other support end from a driven member of a lifting means by being reeved around circular suspension element deflection supports which are in integral rotation with the suspension elements and are mounted on two parallel shafts, each end of the load support having one of said shafts mounted towards said respective end, and the circular supports located adjacent the same end of the load support being mounted on one and the same shaft. The device being arranged so that each suspension element of the system of the invention is connected to its associated lifting means at the end of the load support opposite the end of the load support at which the other suspension element is connected to the other lifting means, that at least one of the suspension elements is reeved successively around at least two coaxial circular supports towards each load support end to follow such a path that, on at least one of the end shafts, at least one circular support associated with said one suspension element rotates in the same direction as at least one coaxial circular support associated with the other suspension element, under identical action of the two lifting means related to the suspension elements, whereas a torque of equal intensity and opposite direction is applied to said two circular supports, respectively when their common shaft is constrained downwardly by a same force independently of the action of the lifting means. Thus, according to the invention, by interlocking these two circular supports, the effect of said force is substantially cancelled, without thereby affecting the action of the lifting means on the circular supports through the intermediary of the suspension elements.

Consequently, in case of a nacelle, if the bottom of the nacelle constituting the load support is initially placed in a horizontal position, the device according to the invention substantially maintains it in that position if a person or persons standing in the nacelle move from one end of the same towards the other. The invention permits to adapt the achievement of this result with the upward and downward movement of the support i.e. of the nacelle.

According to an advantageous embodiment, the two suspension elements follow each a path around at least two circular supports towards each end of the load support to allow for their respective movements to be interlocked at the two ends of the load support by coupling at least two adjacent circular supports directly together.

According to another advantageous embodiment the two suspension elements follow each a path around at least two circular supports towards each end of the load support to allow for their respective movements to be interlocked at the two ends of the load support by coupling at least three adjacent circular supports, directly together.

BRIEF DESCRIPTION OF THE SEVERAL VIEWS OF THE DRAWINGS

The system for the suspension and hoisting of a load support will now be explained in greater detail with respect to the annexed figures, wherein:

The FIGS. 1–3 show a prior art system for the suspension and hoisting of a load support;

The FIGS. 4–10 show a schematic representation of a system for the suspension and hoisting of a load support.

Figure 1:
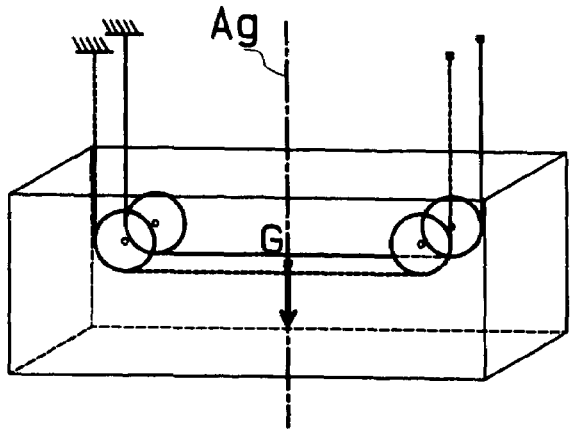
Figure 2:
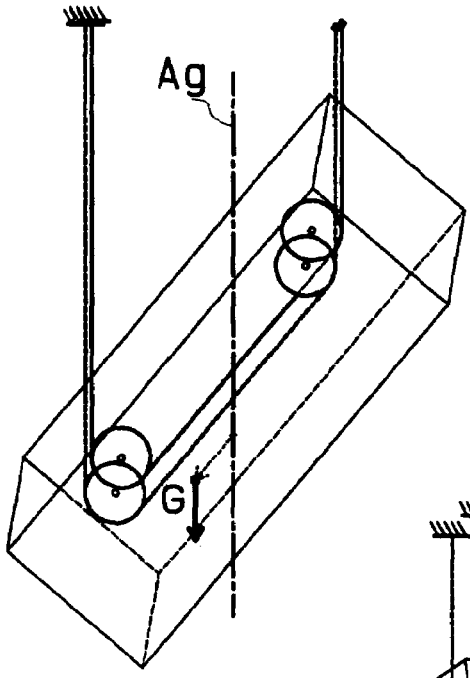
Figure 3:
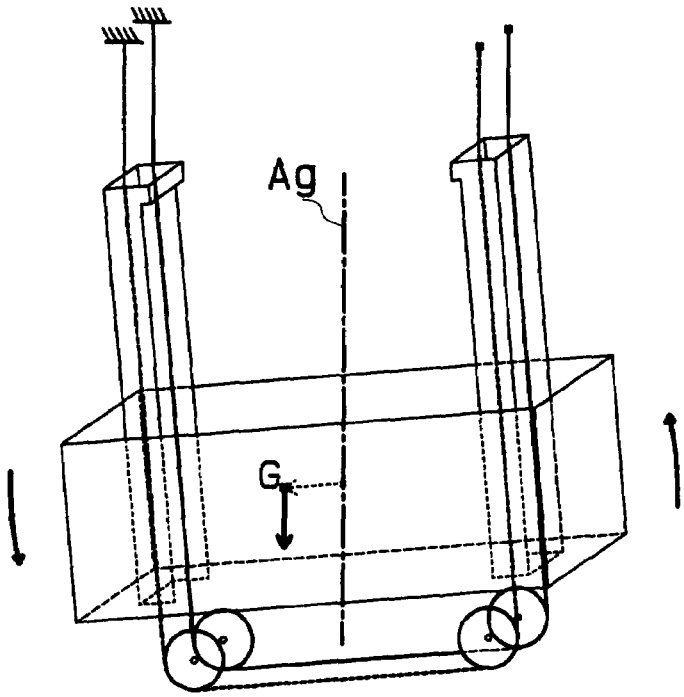
Figure 11:
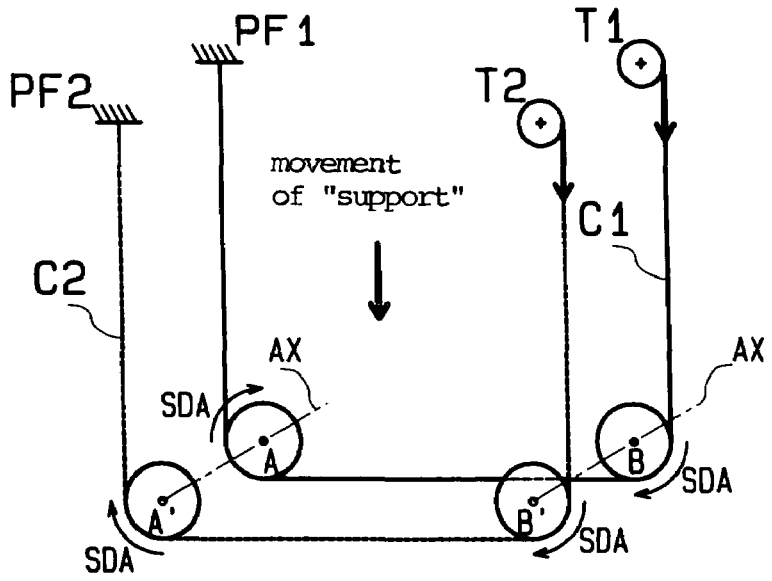
Figure 12:
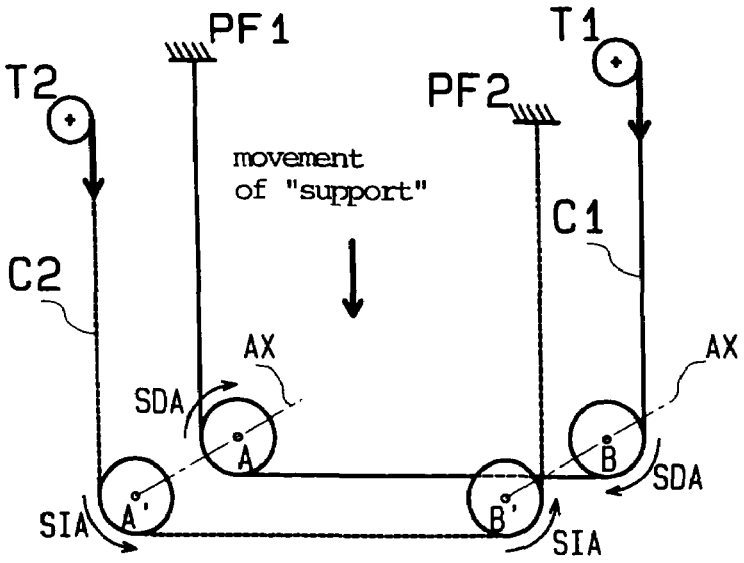
Figure 13:
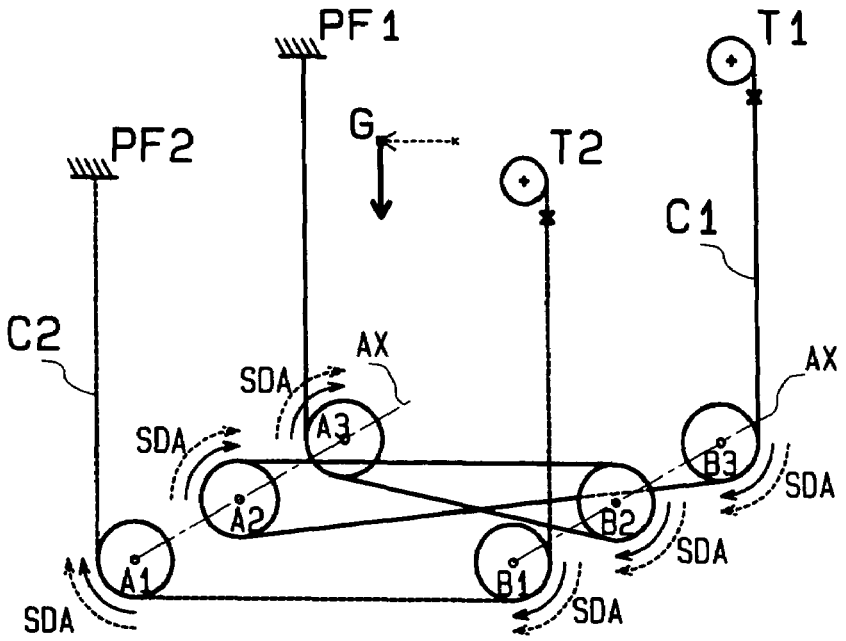
Figure 14:
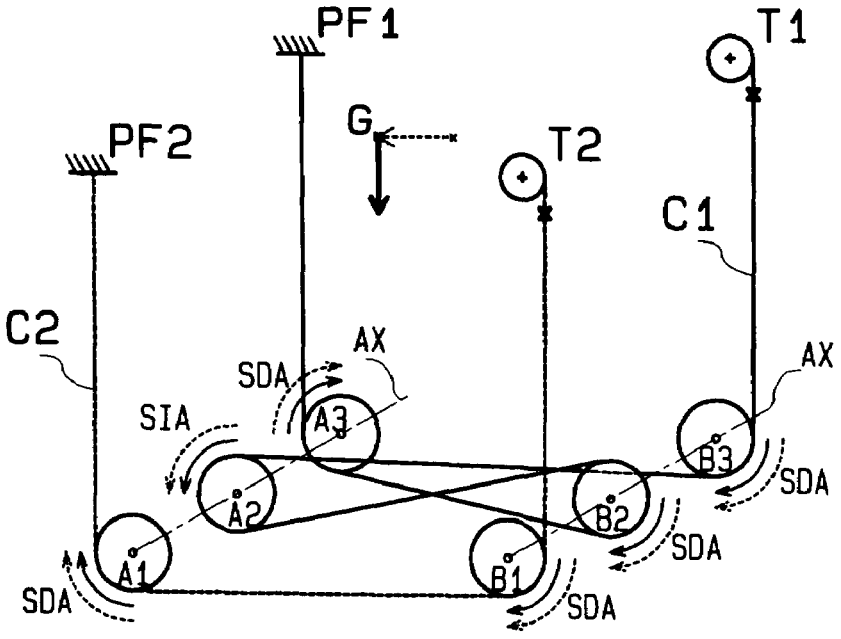
Figure 15:
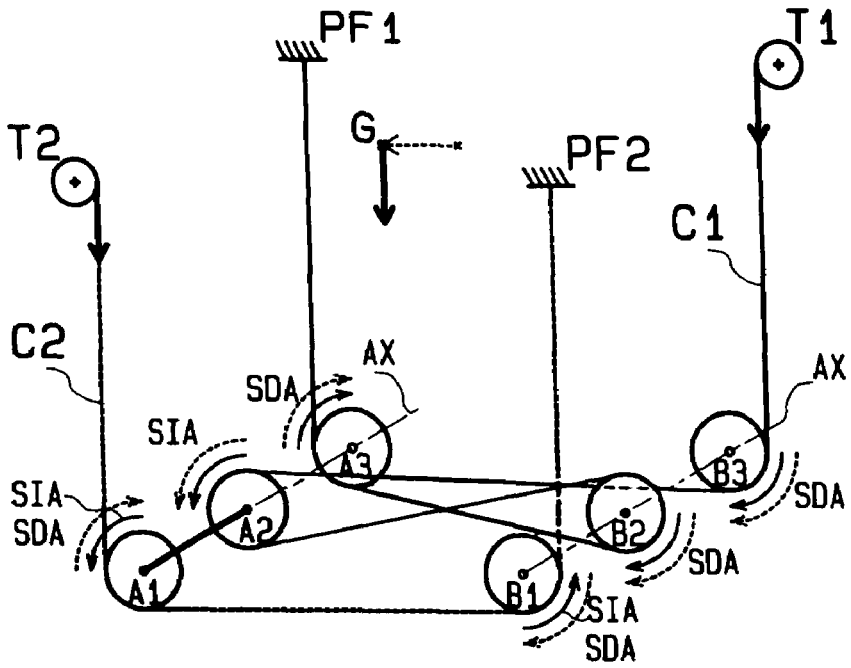
Figure 16:
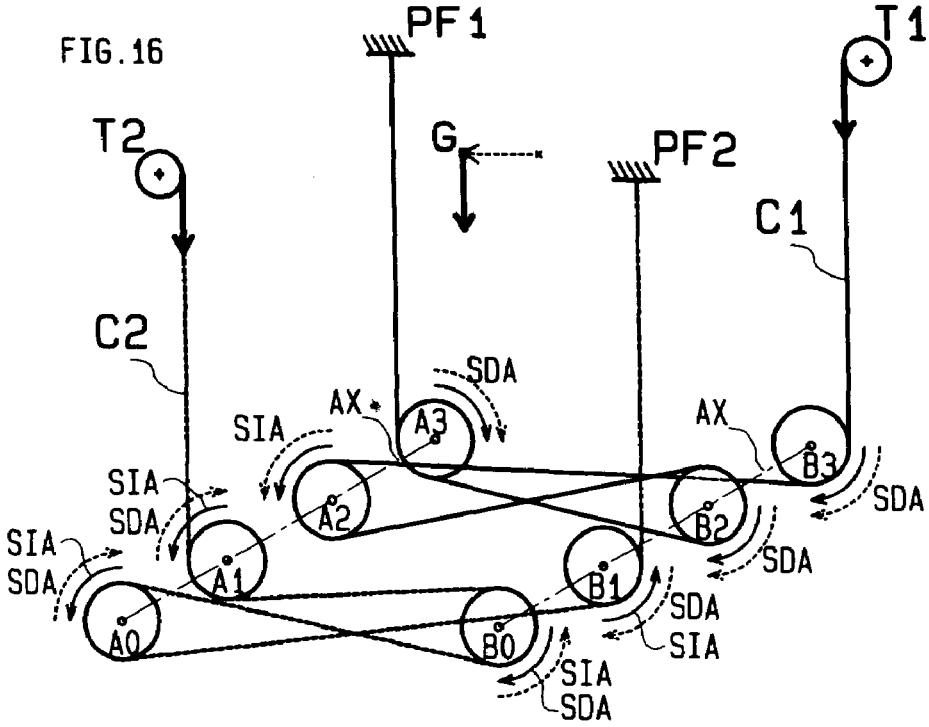
Figure 17:
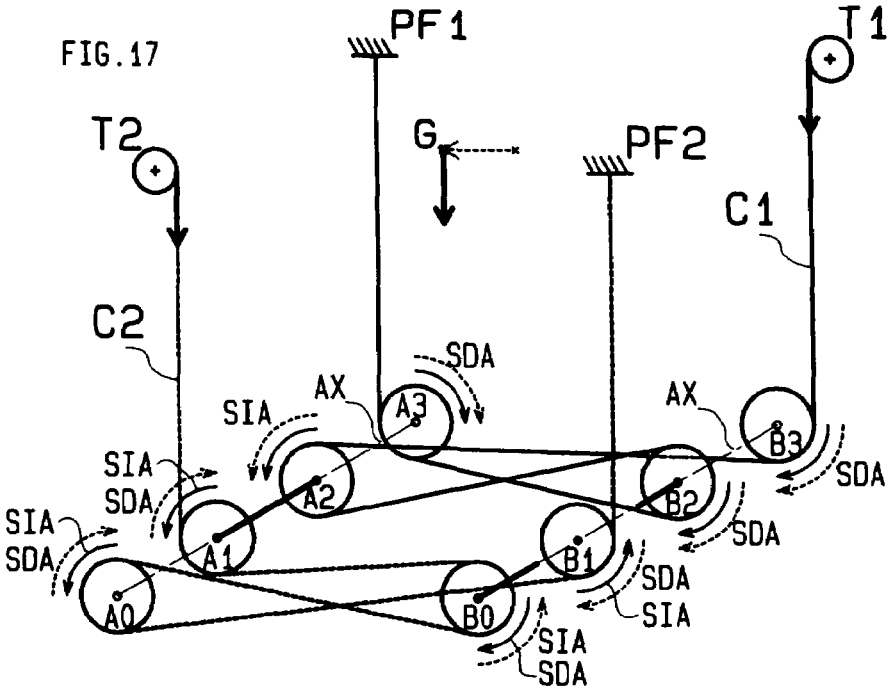
Figure 18:
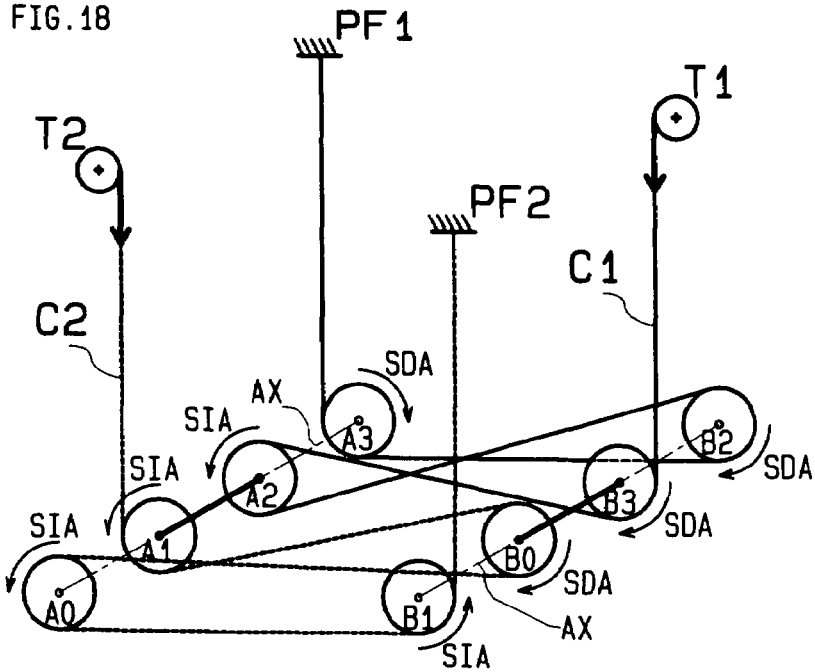
Figure 23B:
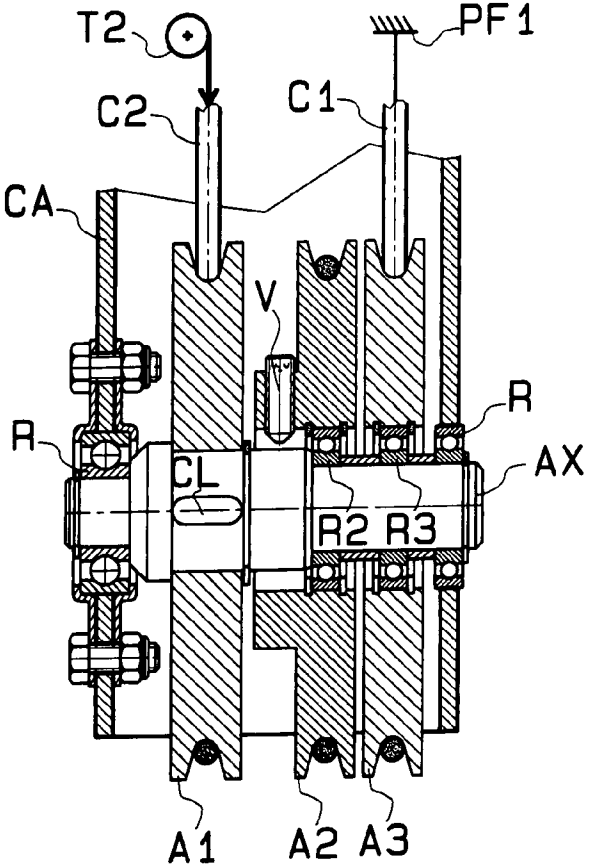
Figure 23A:
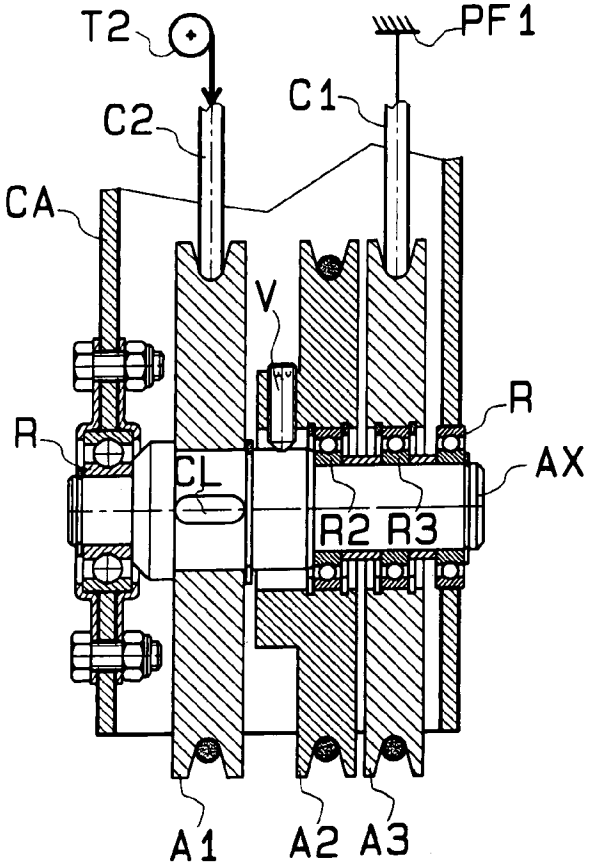

The FIG. 11 shows a two-cable-system corresponding to FIG. 1;

The FIG. 12 shows a two-cable-system whose winches are located above the opposite ends of the support;

The FIG. 13 shows a two-cable-system whose winches are provided above the same ends of the support, one of the cables being tackled without crossing of the cable;

The FIG. 14 shows a two-cable-system whose winches are located above the ends of the support, one of the cables being tackled with crossing of the cable;

The FIG. 15 shows a system according to a first embodiment of the invention, that is to say a two-cable-system whose winches are located above opposite ends of the support, and with one cable circuit being tackled with crossing of the cable, and with two pulleys associated with a different cable circuit, but rotating in the same direction under identical action of the two winches and constrained to rotate in opposite directions in case of displacement of the load on the support, being interlocked with one another;

The FIG. 16 shows a system according to the invention, whose two cable circuits are tackled;

The FIGS. 17–22 show different embodiments of the invention, wherein the two cable circuits are tackled, and which are distinguished from one another by the interlocking of different pulleys;

The FIGS. 23A and 23B show in cross-section the three pulleys mounted on the common left end shaft of the embodiment of FIG. 15, the intermediate pulleys associated with the tackled cable circuit being interlocked with the pulley associated with the simple cable circuit in the FIG. 23A and these two pulleys being de-coupled in the FIG. 23B.

Figure 19:
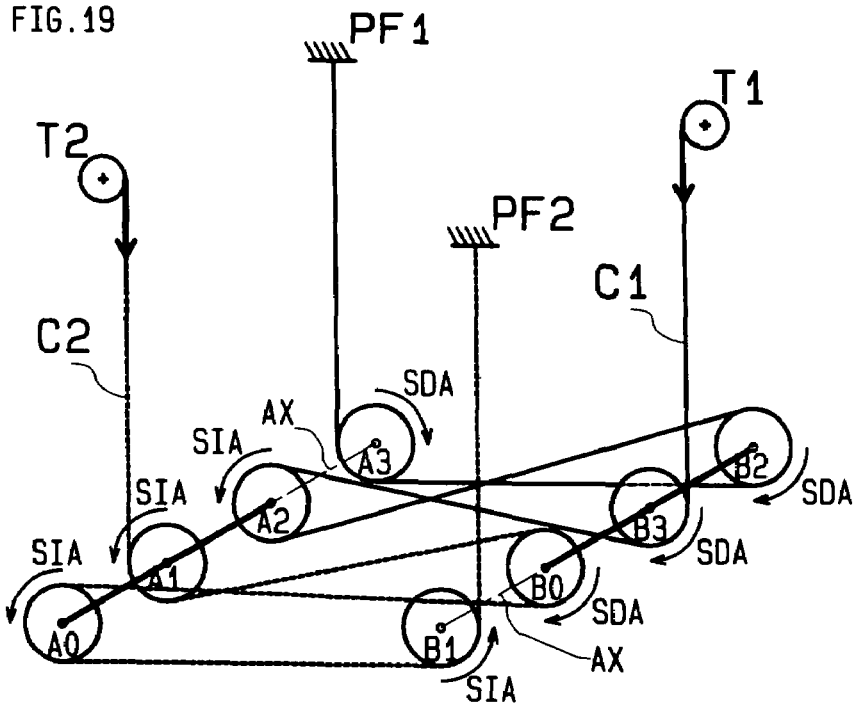
Figure 20:
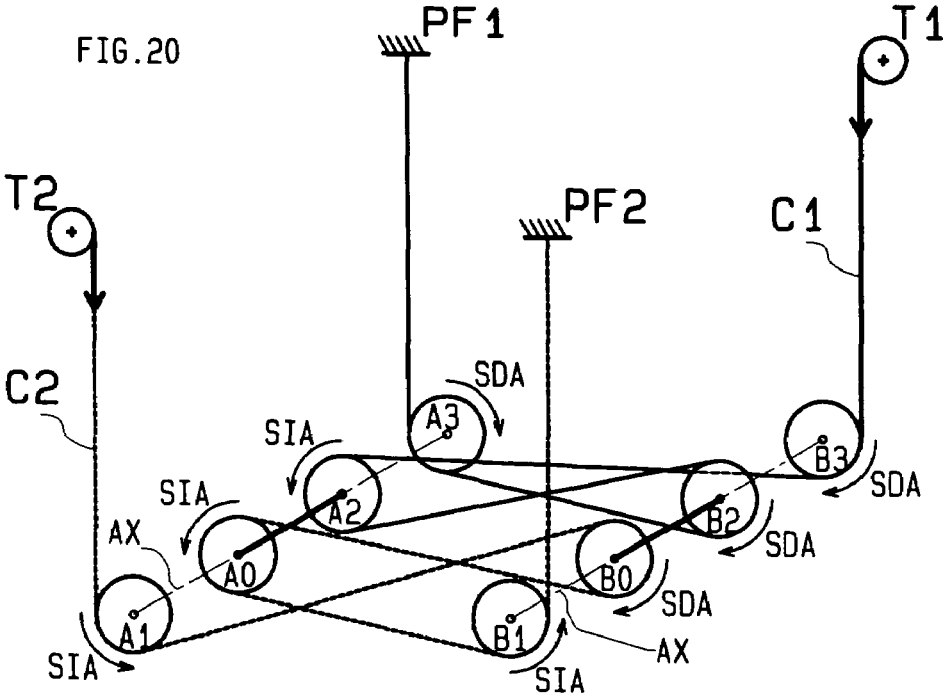
Figure 21:
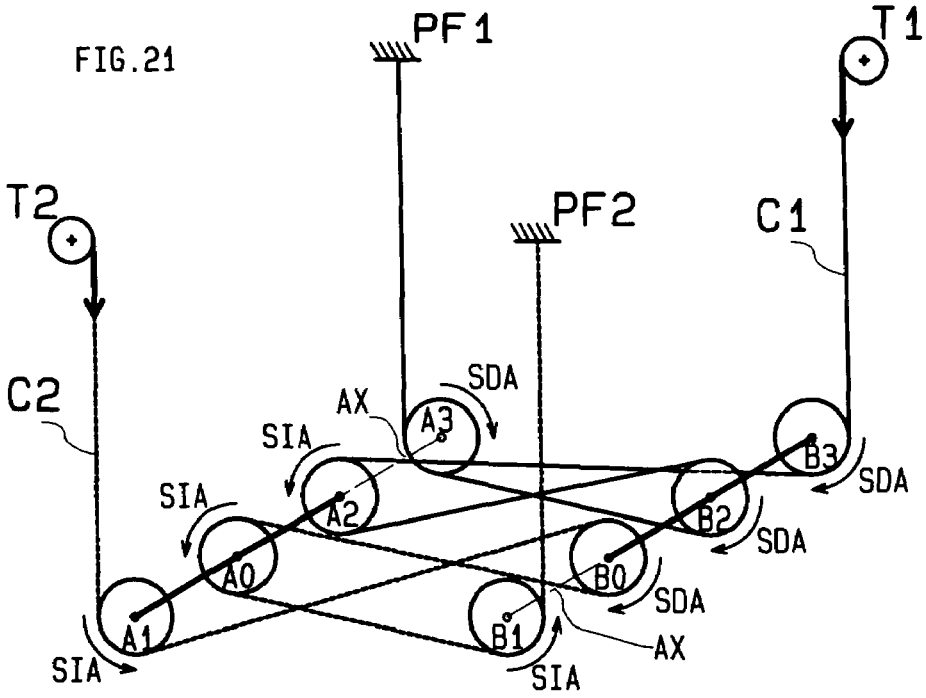
Figure 22:
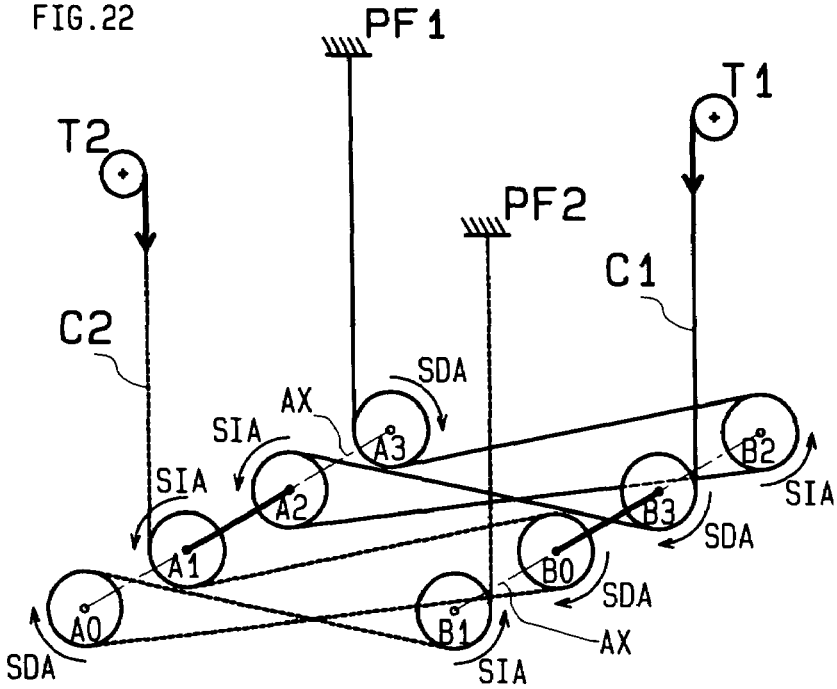
Figure 24B:
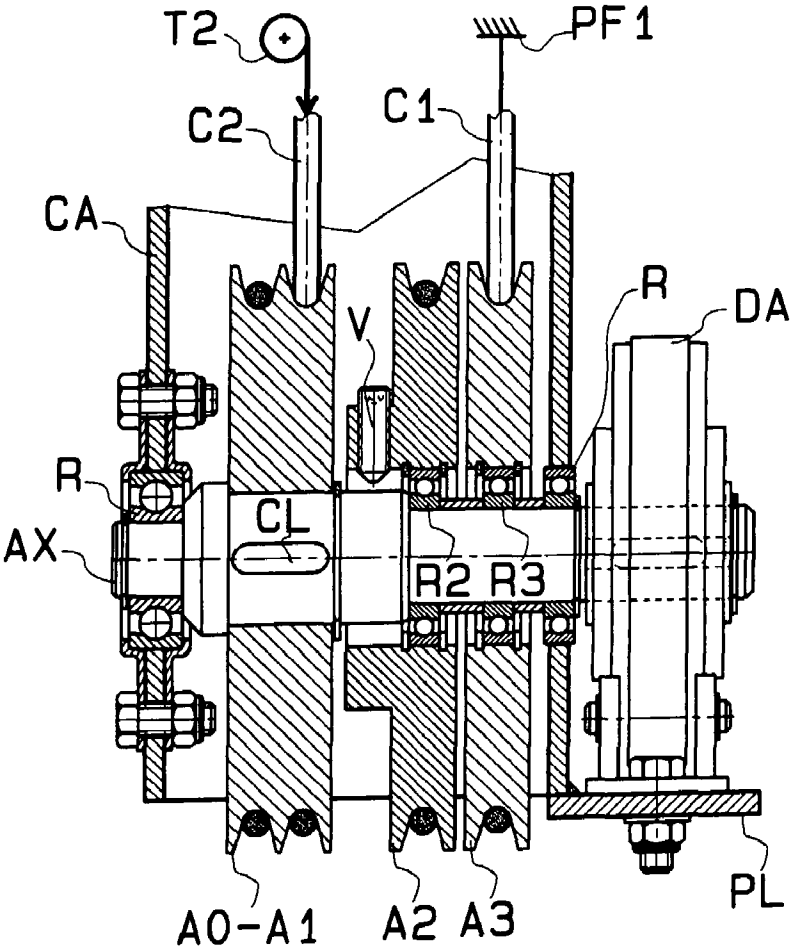
Figure 24A:
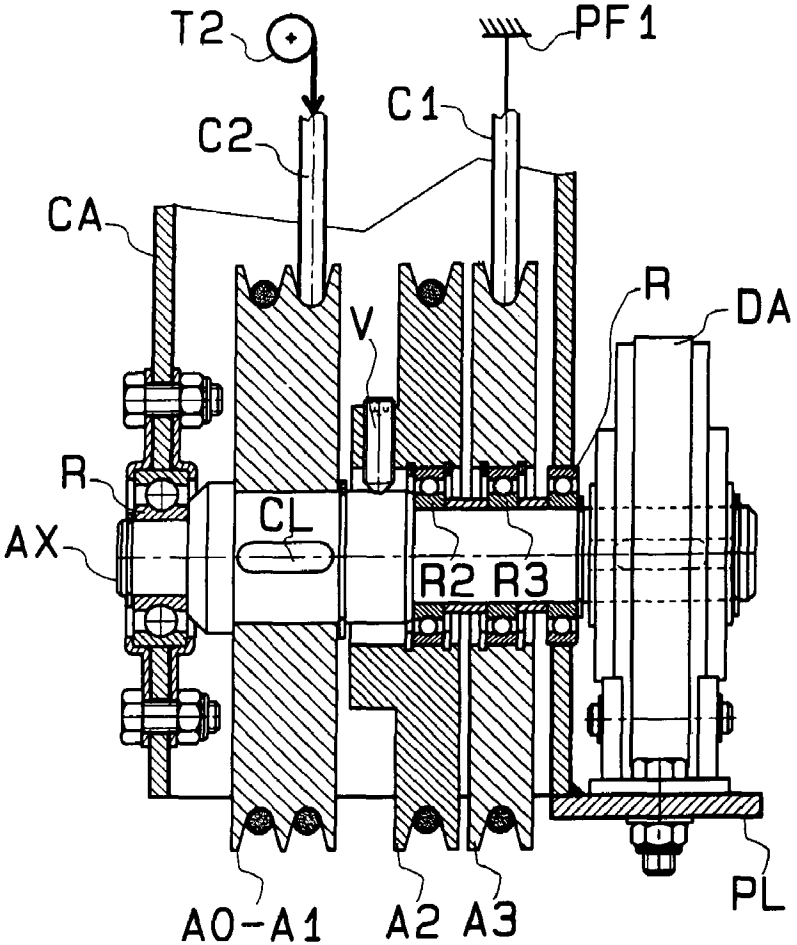
Figures 25A, 25B:
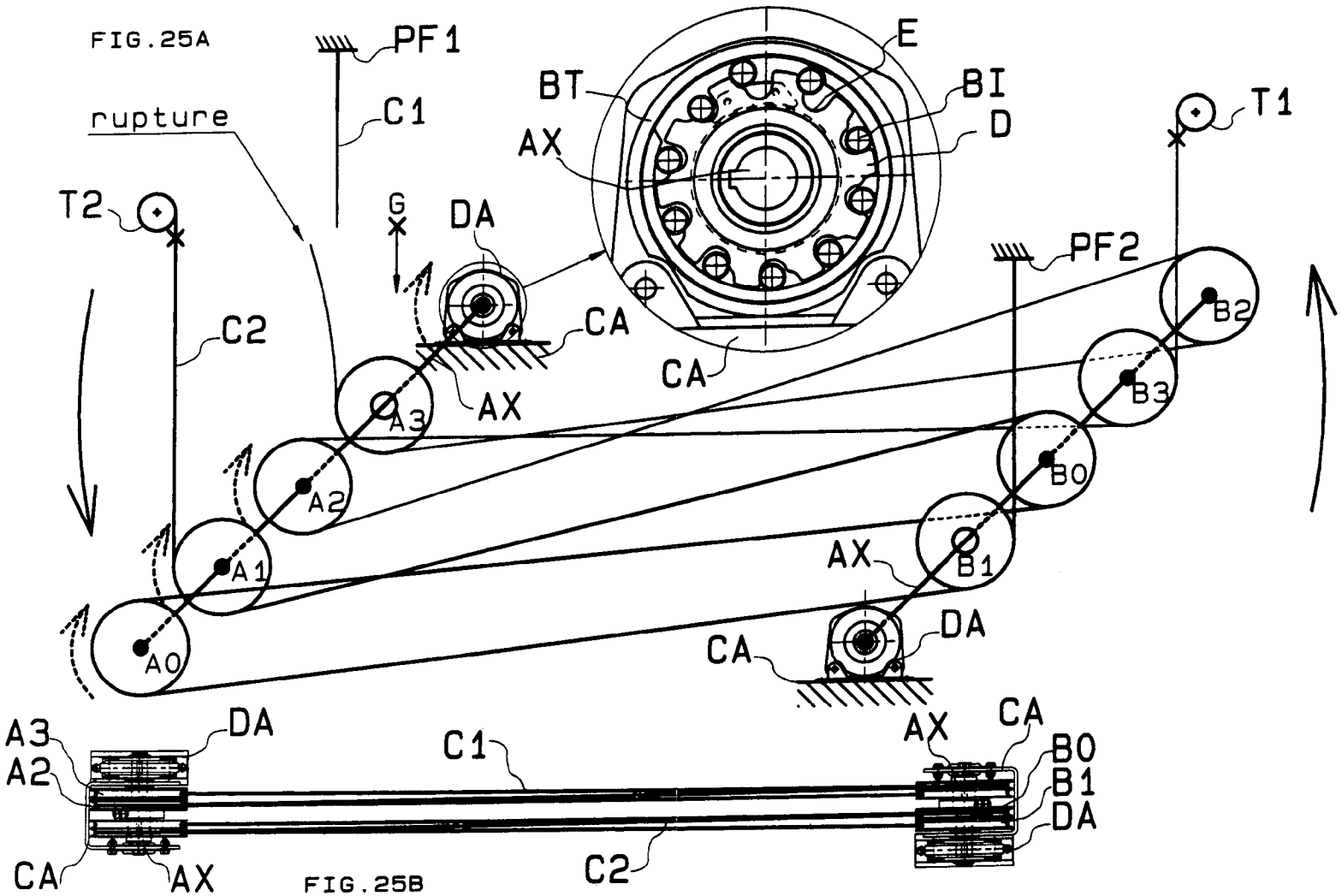
Figure 26:
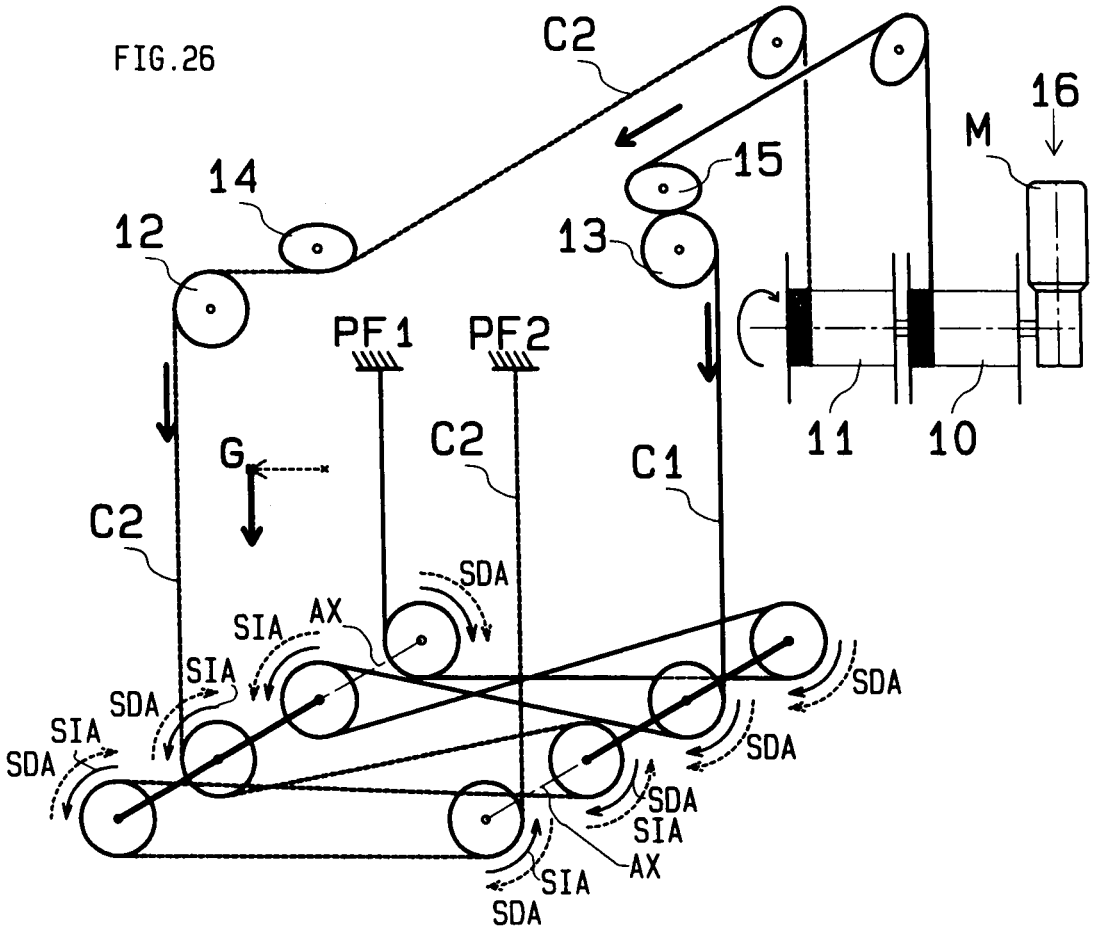

The FIGS. 24A and 24B show in cross-section the four pulleys mounted on the common left end shaft of the embodiment of the FIG. 19, the intermediate pulleys associated with the first tackled cable system being interlocked with the double pulley associated with the other tackled cable system in FIG. 24A and these pulleys being de-coupled in FIG. 24B, and including an anti-fall device for each end shaft;

The FIGS. 25A and 25B show the system of FIG. 19 including an anti-fall device for each of the two shafts; and The FIG. 26 shows the preferred embodiment with the drums of the two winches being keyed to the drive shaft of a single motor.

DETAILED DESCRIPTION OF THE INVENTION

To facilitate the understanding of the invention and its features of novelty, there will be recalled the properties of the simplest suspension and hoisting system that was in use prior to the invention and consisted of a single suspension cable actuated by a single winch. Thereafter it will be explained as to how the invention permits to achieve the desired result by adding a second suspension cable.

Hereinafter the pulleys located on the left end shaft will be designated "A" and the pulleys located on the right end shaft will be designated "B".

The following description will refer to a cable but it is to be understood that instead of the cable any suspension element capable of cooperating with a circular support can be used.

I / Description of an Elementary Scheme of a Suspension and Hoisting System

FIG. 4 shows a known load suspension and hoisting system comprising a support or nacelle S, that can be schematically shown in plan view by a rectangular frame comprising at each end, when considered in longitudinal direction, a transverse shaft Ax, the two shafts Ax being parallel and horizontal and carrying each a pulley A, B, and further having a cable C for the suspension of the support S, the cable C being fixed at an upper point Pf disposed vertically above one end of the support S, reeved around the two pulleys A, B of the support and being then wound about a winch T fixed at a point disposed vertically above the other end of the support S.

FIG. 4 shows the support S in a schematic elevational view and FIG. 5 shows the corresponding support in plan view. Instead of the nacelle, structures, such as a lifting beam, may be provided for the support.

In the following description concerning the present invention, only the cables and pulleys are shown to simplify the figures. It is to be understood that the shafts of the pulleys supporting the suspension cables are integrated to the support to ensure the vertical suspension and movement thereof. Thus, the system of FIG. 4 referred to above will be represented by the schematic representation of FIG. 6.

In the following explanations relating to the direction of rotation of a pulley it will always be considered related to a downward movement of its shaft.

Two conditions of movement of each pulley have to be considered.

a) There may be considered such a system in balanced static horizontal position when the load applied to the support S is equally distributed to each end of the support, and assuming that the dead weight of the support is also equally distributed. In this case, if the winch T, located for example above the left end of the support S, unwinds the cable C, the support S moves downwardly while retaining its horizontal position, the two pulleys A, B, driven by the movement of the cable C, will rotate in the same direction, that is to say both will rotate in a counterclockwise direction (SIA). If the winch T had been located above the opposite end, namely above the right end, the two pulleys A, B, for the same lowering motion of the support S, would both rotate in an opposite direction, namely in clockwise direction (SDA). This comparison is illustrated by FIG. 7, for the case with the winch T disposed above the left end of the support S, and by FIG. 8 for the case with the winch T located above the right end.

Figure 7:
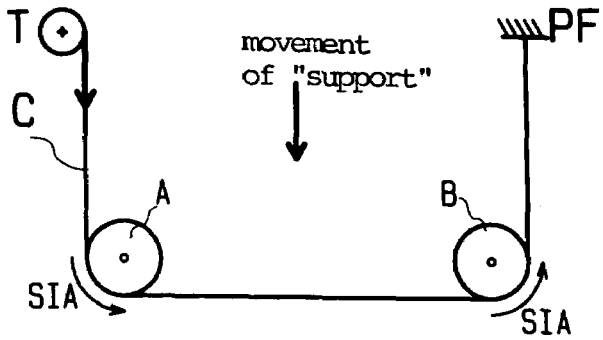
Figure 8:
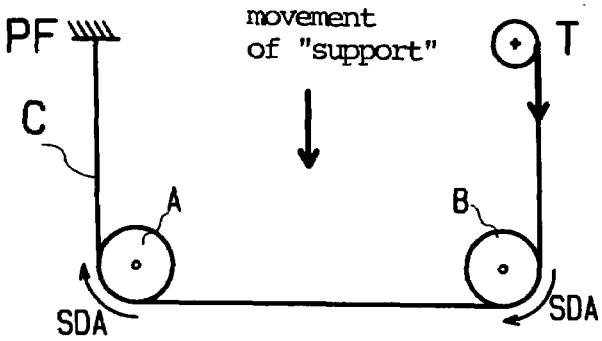

In FIGS. 7 and 8 and the subsequent figures the direction of rotation of each pulley is indicated by a full-line arrow for the case of movement described hereinbefore.

b) If now, with the winch T being remaining stationary, the load, initially balanced, is displaced towards the left end of the support S, that end will be subjected to a downwardly direct force causing an inclination of the support, which will cause rolling displacement of the two pulleys A and B on the cable C remaining stationary so that the left pulley A subjected to this force will move downwardly. On the other side, the pulley B provided at the right end will move upwardly, as the total length of the cable C will remain fixed as well as the length of the cable reach interconnecting the two pulleys A and B, while the vertical right end cable reach must shorten.

Figure 9:
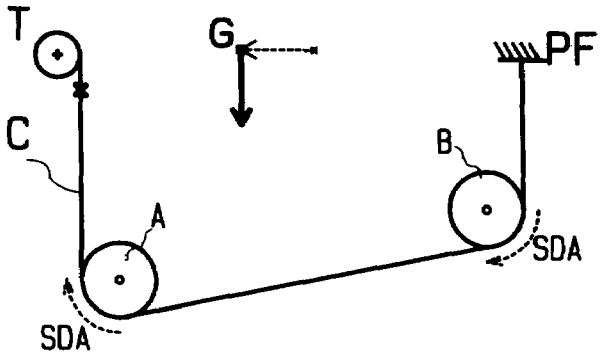
Figure 10:
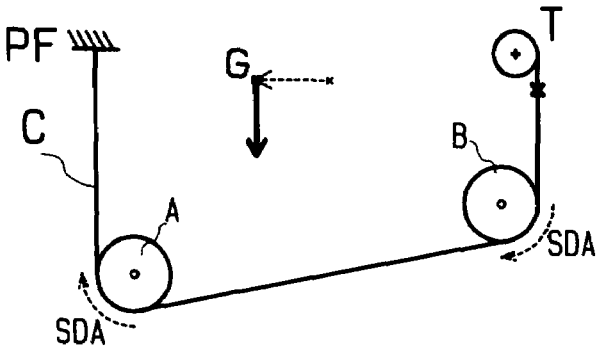

During its downward movement, the left end pulley A, rolling on the stationary cable C, will rotate in the direction (SDA) namely in the direction opposite to the direction SIA in which it rotated under the action of downward movement of the winch T disposed above the pulley A. There is shown in FIG. 9 a condition in the course of this motion for a load displaced towards the left end in the figure. To the contrary, if, previously, in the case b) referred to above, this same left end pulley had been located under the fixed suspension point Pf, and the winch had been provided above the other end of the support S, this pulley A, in its downward rolling motion, would move under the effect of the displacement of the load in the same direction (SDA) as previously referred to under the lowering action of the winch T, as shown in FIG. 10. In effect, in the considered circumstances, the side where the winch is located is no longer relevant, in view of the fact that the winch T does not move and behaves as the opposite fixed point.

In the FIGS. 9 and 10 and on the subsequent figures the direction of rotation for each pulley is indicated by an dotted-line arrow for the case of movement referred to above.

The directions of pulley rotation, in this case, are of course identical independently of the support end where the winch T is located, whereas they were reversed by changing the end of the support at which the winch is located, when movement of the pulleys was caused by winch rotation.

c) It can thus be concluded that there are two condition of possible movement of the system:

1/ A condition in which the movement is caused by the winch T, the cable C entraining by its movement the rotation of the pulleys A and B (full arrows), 2/ the other condition in which, the winch being at rest, the movement is caused by rolling of the pulleys A and B on the stationary cable C when the load displaces towards one end of the support (dotted arrows).

In the second case, the direction of rotation of a pulley A or B, for a vertical movement in the same direction as in the first condition, will be the same as in the first condition for the pulley located at the end of the fixed suspension point, and will be in the opposite direction for the pulley located at the end of the winch.

Of course, the two conditions may arise simultaneously in combination, when the charge is displaced on the support during lowering or lifting of the support by the winch T.

II / System Developed by Duplication of the Cable

One may wish to mount the system by means of two cables C1, C2 instead of a single cable. This permits to actuate four cable reaches of suspension by only two winches T1, T2 and, thus, to double the safety.

If the cables are identically mounted, the result will be the same as previously explained. FIG. 11 illustrates this system, which is a duplication of the system of FIG. 8.

If the winch T2 of the second cable C2 is placed at the opposite side of the first winch T1, the movement of the support S will again be the same in the two operating conditions explained hereinbefore, but the direction of rotation of each pulley A', B' associated with the second cable C2, in case of vertical displacement by the winches T1, T2, will be opposite with respect to the direction of rotation of the pulley A or B located in corresponding position on the first cable T1 for the same direction of vertical displacement as in the previous system. In other words, the coaxial pulleys A, A' and B, B' (each associated with a different cable) will rotate in opposite directions one with respect to the other. In this case, the coaxial pulleys A, A' and B, B' must be mounted freely on their shaft Ax. The FIG. 12 shows this system.

In all cases, the winches must of course wind up and wind off the cable at an identical linear speed to obtain an appropriate vertical movement of the support.

III / Developed System by Having of One of the Two Cables Tackled

The object of the invention is to stabilize the position of the support in case of displacement of its load while permitting simultaneous upward or downward movement of the two cables under the action of their respective winches.

To this effect, and as shown in FIG. 15, at least one of the two cables is tackled, by reeving it around at least two pulleys A2, A3 and B2, B3 on each shaft Ax of the support, namely about at least four pulleys, so as to obtain a cable circuit such that, on one and the same shaft Ax it is ensured that one pulley associated with the tackled cable rotates in the same direction as the coaxial pulley A1, B1 of the non-tackled circuit under identical action of the two winches (downward or upward movement) and are constrained, by an off-center load, to rotate in a direction that is opposite to the direction of rotation of the pulley of the non-tackled cable circuit, in rolling movement of the pulleys on the stationary cables. The object of the invention is then achieved by interlocking these two pulleys.

The pulleys A1, A3, B1, B3 disposed at the lower end of the vertical cable reaches will be referred to as "end pulleys", and the other pulleys A2, B2, namely the pulleys which are interconnected by the transverse cable reaches, each only to another pulley, will be referred to as "intermediate pulleys".

The left end pulley (in direct suspension) of the simple cable will be referred to as pulley A1, the intermediate left end pulley of the tackled cable will be referred to as pulley A2 and the left end pulley of the tackled cable will be referred to as A3. Corresponding references will be used for the right end pulleys.

The non-tackled cable C2 is referred to as the "simple cable".

A / Inclination Movement Under the Effect of an Off-centered Load on the Support, with the Winches Remaining Stationary It has been seen that, for this type of movement, the position of the winches T1 and T2 is indifferent. Thus, assuming, for the simplest system, that the two winches T1, T2 are located above the same end, for example the right end, and the tackled cable interconnects the pulleys A2, A3 and B2, B3 without crossing of the transverse cable reaches, as shown in FIG. 13, and considering the example of the load being displaced towards the left end.

It has been seen that the end pulleys A1, A3 and B1, B3 located at the same end (thus coaxial and suspended directly, be it from a fixed point or from a winch), are urged to rotate in the same direction of rotation when the load moves off-center on the support. For example, for a leftward displacement of the load and thus a downward movement, the two pulleys A1 and A3 will rotate in the direction SDA. By crossing the transverse cable reaches of the tackled cable of FIG. 13 between pulleys A2, B2 and B3 as shown in FIG. 14, the direction of rotation of the pulley A2 will be reversed to obtain the direction of rotation SIA.

If the pulleys A1 and A2 were interlocked the desired stabilization effect would thus be achieved, as these two pulleys, each associated with a different cable circuit, would then be constrained, under the effect of a displacement of the load on the support, by equal and opposite torques. To this effect, the interlocked coaxial pulleys must have the same primary diameter.

The word "crossing" means that one transverse cable reach is from a lower side of an end pulley to an upper side of an intermediate pulley, the next transverse cable reach is from the lower side of the intermediate pulley to the upper side of the other intermediate pulley and the subsequent transverse reach is from the lower side of the other intermediate pulley to the lower side of the other end pulley.

B / Vertical Movement of the Support Caused by Winch Operation (Centered Load)

By reversing the direction of rotation of the pulley A2, by crossing the transverse reaches of the tackled cable, its direction of rotation has been reversed when it rolls on the fixed cable C1 in case of displacement of the load, but its direction of rotation has also been reversed under the action of the cable C1 of the winch T1, which winch, in the selected example, is disposed above the opposite end of this pulley (at the left side in the figure). This direction of rotation is thus opposite to the direction of rotation of the pulley A3, and thus opposite to the direction of rotation of the pulley A1, as the two winches are provided above the same end of the support. Thus, it follows that by interlocking the pulleys A1 and A2, the vertical movement of the support would no longer be possible.

To re-establish the same direction of rotation for the pulleys A1 and A2 under identical action of the two winches, one of the two winches must accordingly be transferred to the opposite end of the support. For example, the winch of the simple cable C2 has been transferred to the left end. By this modification, the direction of rotation of the pulley A1 under the action of the winch will be reversed, as it has been explained hereinbefore that an end pulley, under the action of its winch cable, rotates in opposite direction depending on whether it is provided at the end of the fixed point or at the end of the winch. This system is illustrated in FIG. 15.

Thus, the pulleys A1 and A2 will rotate in the same direction and at the same speed under identical action of the two winches T1 and T2. However, they remain constrained to rotate in opposite direction in case of displacement of the load on the support.

Accordingly, they can be interlocked for the purpose of achieving the desired result, namely to prevent substantially any tendency of the support to incline in the longitudinal direction, while generally maintaining the normal vertical displacability of the support by the winches T1, T2. This interlocking of the pulleys is schematically shown in FIG. 15 by a heavy line interconnecting the center of the pulley A1 with the center of the pulley A2. The interlocking can be effected either by locking the hub of the pulleys A1, A2 on their common shaft, on which the pulley A3 is freely rotatable, or by using a pulley having two grooves.

It can be easily understood that the result is identical, whether the load displaces leftwardly or rightwardly. It is also easily understood that the result is the same, independently on whether the winch of the tackled cable or of the simple cable is placed above the left end or the right end of the support, provided that the two winches are located at opposite ends of the support. Accordingly, the same result would have been achieved by mounting the winch of the tackled cable above the left end of the support instead of the winch of the simple cable.

IV / Developed System by Providing Two Tackled Cables

It can be seen that, in the described system, the suspension element is wound only about a quarter turn on each of the two pulleys A1, B1 of the simple cable circuit of which one single pulley provides the cable/pulley friction to neutralize the off-centered load. Particularly in the case of a cable/pulley mounting, it is advantageous to extend to a maximum the arcs of engagement of the cables on the pulleys to increase the cable/pulley friction on which the proper operation of the system depends.

To this effect, both cable circuits can advantageously be tackled in order to obtain the system shown in FIG. 16.

This system also provides a greater choice of interlocking modes as it provides on each shaft Ax four pulleys instead of three.

In this system and in the system of the subsequent figures, the right end intermediate pulley of the additional tackled cable is designated B0, and A0 is the corresponding left end pulley.

For a better balancing of the operation of the system at the both ends of the nacelle, particularly, independently of the direction of displacement of the load, it will be advantageous to provide in addition to the interlocking of the pulleys A1 and A2 also an interlocking of the pulleys B0 and B2 by locking them on their common shaft, which will permit to considerably increase the cable/pulley friction. The pulleys B1 and B3 will remain in free rotation, as well as the pulleys A0 and A3 in FIG. 17.

Possible interlocking modes are indicated in FIGS. 18–22. Preferably the system of FIG. 19 will be selected, in which there are provided at both ends of the nacelle up to three adjacent pulleys that can be interlocked together to obtain the desired effect, or which can also be replaced by pulleys having a triple groove.

In FIGS. 17–22 the interlocking of coaxial pulleys is indicated by heavy lines, as in FIG. 15. The embodiment of FIG. 19 corresponds to the embodiment of FIG. 18 except for the interlocking of the pulleys and the embodiment of FIG. 21 corresponds to the embodiment of FIG. 20 except for the interlocking of the pulleys.

V / Decoupling Device

It may be advantageous to allow for an operation permitting to re-establish the horizontal position of the load support, if this horizontal position has been altered. This alteration can be caused, for example, after a predetermined duration of operation, in the case of a suspension element frictionally engaged with the pulleys, when there has been progressive slippage of the suspension element in the grooves of the pulleys, particularly under the effect of a high load frequently off-centered towards the same end of the support. Further, the adjustment of a predetermined inclination of the load support may be desired, particularly if the load support consists of a lifting beam. To this effect, the present invention incorporates any system for selectively decoupling the coaxial interlocked pulleys. In this context, it can be assumed that the coaxial interlocked pulleys are interconnected by locking their hubs on their common shaft, while the non-interlocked pulleys rotate freely on the same shaft. The decoupling device would then consist, of a known means to decouple from their shafts the hubs of the coaxial pulleys normally interlocked for rotation with these shafts.

Such a decoupling device is shown in FIGS. 23A and 23B, both of which showing the pulleys A1, A2 and A3 mounted on the left end shaft Ax of FIG. 15. On these figures the left end shaft Ax turns in two friction bearings R, R mounted in a cage CA attached to the support S under the same. The pulley A1 pertaining to the simple cable circuit C2 is fixed by a key CL to the shaft Ax to rotate therewith. Each of the remaining pulleys A2 and A3 associated with the tackled cable circuit C1 is mounted by an antifriction bearing R2, R3, respectively, on the shaft Ax. According to FIG. 23A the pulley A2 is interlocked with the pulley A1 by a set screw V clamped on the shaft Ax so that this pulley A2 is fixed for rotation with the shaft Ax and accordingly interlocked with the pulley A1 keyed to this shaft Ax. This set screw V serves also as a decoupling means in that it permits after loosening and disengagement from the shaft Ax the free rotation of the pulley A2 on the shaft Ax.

The FIG. 24A shows the interlocking of the pulleys A0, A1 and A2 on the left end shaft Ax of the embodiment of FIG. 19 having two tackled cable circuits C1 and C2. The pulleys A0 and A1 associated with the cable C2 are interlocked together by using a double pulley and the pulley A2 is interlocked by a set screw V to the shaft Ax and thus with the double pulley A0–A1. To decouple the pulley A2 from the double pulley A0–A1 the set screw V is loosened and disengaged from the shaft Ax (see FIG. 24B).

VI / Anti-fall Device

According to one particular embodiment, it can be advantageous to remedy to the consequences of a possible failure (rupture) of one of the two suspension elements. This rupture would have the effect of neutralizing the system, and, in case of an off-centered load, the support might incline suddenly up to a position closely approaching vertical. To avoid this consequence, the invention incorporates also the addition, in the suspension system, of an anti-fall device which engages on the associated end shaft, to block it in case of acceleration of its rotational movement to exceed a predetermined acceleration and/or rotational speed limit, particularly in case of rupture one of the two suspension elements.

The FIG. 25A shows the embodiment of FIG. 19 with such a anti-fall device DA provided on each of the end shafts Ax. Each anti-fall device DA is supported by the associated cage CA of the type A pulleys and the type B pulleys, respectively, and each of these anti-fall devices DA comprises a fixed housing BT and a disc member D keyed to the associated shaft Ax for rotation therewith. The disc member D is provided on its circumference with a plurality of recesses E and a ball or a roller BI is received in each recess E. If one of the cable ruptures, for example the cable C1, under the effect of acceleration of the shaft Ax and of the disc member D the balls or rollers BI are forced radially outwardly with respect to the recesses E to engage the interior of the housing BT and prevent further rotation of the shaft Ax. The FIG. 25B shows in plan view the device of FIG. 25A having an anti-fall device DA fixed to the cage CA to the end of the shaft Ax on the side of the two separated pulleys A2, A3 and B0, B1, respectively. The FIGS. 24A and 24B also show the anti-fall device DA mounted on a support plate PL welded to the cage CA.

VII / Preferred Embodiment

According to a preferred embodiment, shown in FIG. 26, instead of having a winch disposed vertically above each end of the support, namely a total of two winches, the two current vertical reaches of the system may be wound about two drive drums or pulleys 10, 11 keyed on the drive shaft of one single motor M.

To this effect, the two reaches in consideration are reeved at the upper end of their vertical extension around a deflection pulley 12, 13 and extend then horizontally towards one another and around another deflection pulley 14, 15 again providing parallel directions of extension of the suspension elements in close proximity with one another to permit their simultaneous winding onto or dewinding from two rotational winding or drive members of a single winch 16. FIG. 26 shows an example of such an arrangement with the preferred version of the double tackled cable system.

This arrangement may be mounted on a remote controlled carriage to permit translational movement of the support in addition to its vertical movement. Further, this arrangement may be provided with anti-fall or anti-inclination safety devices that have been provided on the conventional systems.

The system described hereinbefore can operate with belts instead of cables, and with pulleys having grooves provided with an appropriate shape. It can also function with chains instead of cables and chain sprockets instead of pulleys. The support may have for example the form of a nacelle or a building side platform on which the cables, or equivalent suspension elements, are guided by appropriate devices provided at the upper end of end stirrups. It can also be utilized for the vertical displacement of a lifting beam, or any other load support having an appropriate configuration for the application of the invention.

The invention claimed is:

1. Suspension and hoisting system for a load support, applied towards the two opposite ends of said load support, said load support being suspended by at least four suspension reaches comprised of at least two suspension elements, each suspension element being suspended towards one of said support ends from a fixed point and towards the other support end from a driven member of a lifting means by being reeved around circular suspension element deflection supports which are in integral rotation with the suspension elements and are mounted on two parallel shafts, each end of the load support having one of said shafts mounted towards said respective end, and the circular supports located towards the same end of the load support being mounted on one and the same shaft, each suspension element being connected to its associated lifting means at the end of the load support opposite the end of the load support at which the other suspension element is connected to the other lifting means, that at least one of the suspension elements is reeved successively around at least two coaxial circular supports towards each load support end to follow such a path that, on at least one of the end shafts, at least one circular support associated with said one suspension element rotates in the same direction as at least one coaxial circular support associated with the other suspension element, under identical action of the two lifting means related to the suspension elements, whereas a torque of equal intensity and opposite direction is applied to said two circular supports, respectively, when their common shaft is constrained downwardly by a same force independently of the action of the lifting means, and that said two circular supports are interlocked, whereby the effect of said force is substantially cancelled without thereby affecting the action of the lifting means on the circular supports through the intermediary of the suspension elements.

2. The system according to claim 1, characterized in that the two suspension elements each follow a path around at least two circular supports towards each end of the load support to allow for their respective movements to be interlocked at the two ends of the load support by coupling at least two adjacent circular supports directly together.

3. The system according to claim 1, characterized in that the two suspension elements each follow a path around at least two circular supports towards each end of the load support to allow for their respective movements to be interlocked at the two ends of the load support by coupling at least three adjacent circular supports directly together.

4. The system according to claim 1, comprising a device for decoupling the normally interlocked coaxial circular supports, so as to make them selectively and temporarily independent in rotation one from the other or the ones from the others, and to permit manoeuvring thereof to re-establish the horizontal position of the load support, if necessary, or to adjust a desired inclination thereof.

5. The system according to claim 1, characterized in that the suspension elements are cables, cooperating with pulleys of corresponding peripheral shape, said cables having a coefficient of friction to permit engagement with the pulleys substantially without slippage.

6. The system according to claim 1, characterized in that the suspension elements are belts, cooperating with pulleys of corresponding peripheral shape, said belts having a coefficient of friction to permit engagement with the pulleys substantially without slippage.

7. The system according to claim 1, characterized in that the suspension elements are constituted by chains and the circular supports by sprockets whose toothing corresponds to the configuration of the chains.

8. The system according to claim 1, characterized in that the upper portion of each suspension reach of the suspension elements connected to a lifting means is deflected laterally towards the other suspension reach, the two suspension reaches thusly brought closer towards one another being deflected a second time to re-establish their parallel extension with respect to one another in the same direction to allow them to be wound on two winding members interlocked with one single drive means.

9. The system according to claim 1, comprising at least one anti-fall device engageable on one of the end shafts to arrest the same in case of acceleration of its rotational movement beyond a predetermined limit of acceleration and/or speed of rotation, in particular in case of failure of one of the two suspension elements.

* * * * *